US006494630B2

(12) United States Patent
Williams et al.

(10) Patent No.: US 6,494,630 B2
(45) **Date of Patent: *Dec. 17, 2002**

(54) DATUM STRUCTURE FOR COMPACT PRINT CARTRIDGE

(75) Inventors: Kenneth R Williams, Vancouver, WA (US); James P. Kearns, Corvallis, OR (US); Jeffrey T Hendricks, Camas, WA (US); Jose Antonio Alvarez, Madrid (ES); B Michael Eckard, Cariff, CA (US)

(73) Assignee: Hewlett-Packard Company, Palo ALto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 22 days.

(21) Appl. No.: 09/431,712

(22) Filed: Oct. 31, 1999

(65) Prior Publication Data

US 2002/0015608 A1 Feb. 7, 2002

(51) Int. Cl.[7] ..... B41J 1/60
(52) U.S. Cl. ..... 400/175; 347/20
(58) Field of Search ..... 400/175, 439, 400/174, 124.11, 124.29; 346/140.1; 347/20, 21, 50, 66, 84, 85

(56) References Cited

U.S. PATENT DOCUMENTS

| | | | | |
|---|---|---|---|---|
| 4,709,248 A | * | 11/1987 | Piatt et al. | 346/140 R |
| 4,755,836 A | | 7/1988 | Ta et al. | 346/140 R |
| 4,872,026 A | * | 10/1989 | Rasmussen et al. | 346/140 R |
| 4,907,018 A | * | 3/1990 | Pinkerpell et al. | 346/139 R |
| 4,940,998 A | | 7/1990 | Asakawa | 346/140 R |
| 4,999,652 A | * | 3/1991 | Chan | 346/140 R |
| 5,138,342 A | * | 8/1992 | Kurata et al. | 346/140 R |
| 5,408,746 A | | 4/1995 | Thoman et al. | 29/890.1 |
| 5,504,513 A | | 4/1996 | Nobel et al. | 347/87 |
| 5,646,665 A | | 7/1997 | Swanson et al. | 347/87 |
| 5,712,669 A | | 1/1998 | Swanson et al. | 347/49 |
| 5,838,338 A | * | 11/1998 | Olson | 347/8 |
| 6,007,184 A | * | 12/1999 | Terasawa et al. | 347/50 |
| 6,024,439 A | * | 2/2000 | Sueoka et al. | 347/50 |
| 6,074,042 A | * | 6/2000 | Gasvoda et al. | 347/50 |

* cited by examiner

*Primary Examiner*—John S. Hilten
*Assistant Examiner*—Darius N. Cone

(57) ABSTRACT

A datum arrangement on the replaceable semi-permanent compact print cartridge includes three x-datums, one y-datum and two z-datums to assure proper seating of the print cartridge in the carriage as well as proper electric and fluidic interconnections.

24 Claims, 13 Drawing Sheets

DATUM STRUCTURE FOR COMPACT PRINT CARTRIDGE

RELATED APPLICATIONS

This application relates to the subject matter disclosed in commonly assigned U.S. patent application Ser. No. 09/431,709, filed Oct. 31, 1999 entitled "Inkjet Printing System With Print head Unit Having Handle With Flexible Legs" by B. Michael Eckard et al., now U.S. Pat. No. 6,364,458 ; U.S. patent application Ser. No. 09/431,710, filed Oct. 31, 1999 entitled "Compact Print Cartridge With Oppositely Located Fluid And Electrical Interconnects" by B. Michael Eckard et al., now U.S. Pat. No. 6,166,771 U.S. patent application Ser. No. 09.431,711 filed Oct. 31, 1999 entitled "Unitary Latching Device For Secure Positioning Of Print Cartridge During Printing, Prining And Replenishment" by Tod S. Heiles et al., now U.S. Pat. No. 6,367,918; and U.S. patent application Ser. No. 08/878,489 filed Jun. 18, 1997 entitled "Inkjet Pen Alignment Mechanism And Method" by Kenneth R. Williams et al., now abandoned.

BACKGROUND OF THE INVENTION

Various problems present themselves in design of current inkjet printers, Modern inkjet printers print at very high resolution, for example, 600 or even 1200 dots-per-inch (DPI). As resolution increases, droplet size typically decreases. With increased resolution and decreased dot size. it becomes more important that the pens be precisely located in the carriage. To accomplish accurate positioning of the pen in the carriage, the pen typically has a set of physical X, Y, and Z datums that are seated against a corresponding set of datums in the carriage stall.

Modern inkjet printers typically print in color and have a plurality of color pens. usually printing in cyan, magenta yellow, and black It is often desirable to provide a different pen for each color, so that if a single pen goes bad, only that pen need be replaced. However, each pen must be precisely aligned with the other colors, or the print quality of the printed images will be degraded. Therefore, the system must not only accommodate precision placement of the pens in the stalls, but precise alignment among the colors.

In addition to the mechanical positioning of the pens within the carriage, the pens must be fluidically connected to trailing tubes. The pens usually interface with some type of valve on the ends of the tubes. The pens make connection with these valves when they are inserted into the carriage stall. However, if the pen and valve interface is not correctly designed, the forces exerted on the pen during fluid interconnection will counteract the precision positioning of the datums, resulting in the pens being misaligned. The fluid interconnection mechanism must be designed so as to not act against the precise positioning resulting from the interaction of the datums.

Recent advances in printhead construction have allowed printheads to be designed to be a permanent or semi-permanent part of the printer, with separate ink cartridges that are fluidically connected in some fashion to the printhead Although the pens are preferably a permanent fixture in the printer, rather than being disposable, it is likely that many such pens will fail before the end of the life of the printer. Therefore, some provision must be made so that the pen can be removed and replaced with a new one. The mechanical datum system and fluid interconnect must also allow the new pen to be reliably and precisely positioned during such replacement. The system would be preferably designed so that installation and subsequent replacements could be done by a purchaser or by a field repair person away from factory conditions.

SUMMARY OF THE INVENTION

The invention provides an inkjet printing mechanism designed to receive an ink jet pen having a needle and a shroud surrounding the needle, the shroud attached to the pen by means of a neck, the pen also having pen datums configured for positioning the pen within a printer carriage. The printer includes a printer chassis and a media movement mechanism mounted to the chassis and constructed to position a print medium in a print zone. A carriage is mounted to the chassis and is constructed to receive the pen and to position the pen over the print zone. The carriage has a notch configured to receive the neck when the stall receives the pen. A valve is movably attached to the carriage and is configured to move with respect to the carriage to be received by the shroud when the notch receives the neck. A septum is positioned on the valve and configured such that when the valve is received by the shroud. the septum is pierced by the needle. A set of carriage datums is formed in the stall and configured to interface with the pen datums. A latching mechanism is associated with the carriage and constructed to seat the pen datums against the carriage datums to finely position the pen with respect to the carriage.

The invention also provides a method of installing an inkjet pen into a carriage of an inkjet printing mechanism. The method includes the steps of: placing the pen in a stall of the carriage to guide a neck on the pen into a notch formed in the carriage; moving the pen further into the stall and, by means of registration of the pen with walls of the pen stall, guiding a shroud on the pen over a valve; urging the pen further into the stall until pen datums formed on the pen come into contact with carriage datums formed in the stall; and seating the pen datums again carriage datums to finely position the pen within the carnage;

The invention thus provides for reliable insertion of inkjet pens within their respective carriage stalls. With successive guiding mechanisms for aligning various parts of the pen with corresponding parts of the carriage. The invention allows for installation or replacements of pens to be reliably and easily done by a purchaser or by a field repair person away from factory conditions.

A datum arrangement on the replaceable semi-permanent compact print cartridge includes three x-datums, one y-datum and two z-datums to assure proper seating of the print cartridge in the carriage as well as proper electric and fluidic interconnections.

DETAILED DESCRIPTION OF THE ILLUSTRATED EMBODIMENTS

Figure 1:
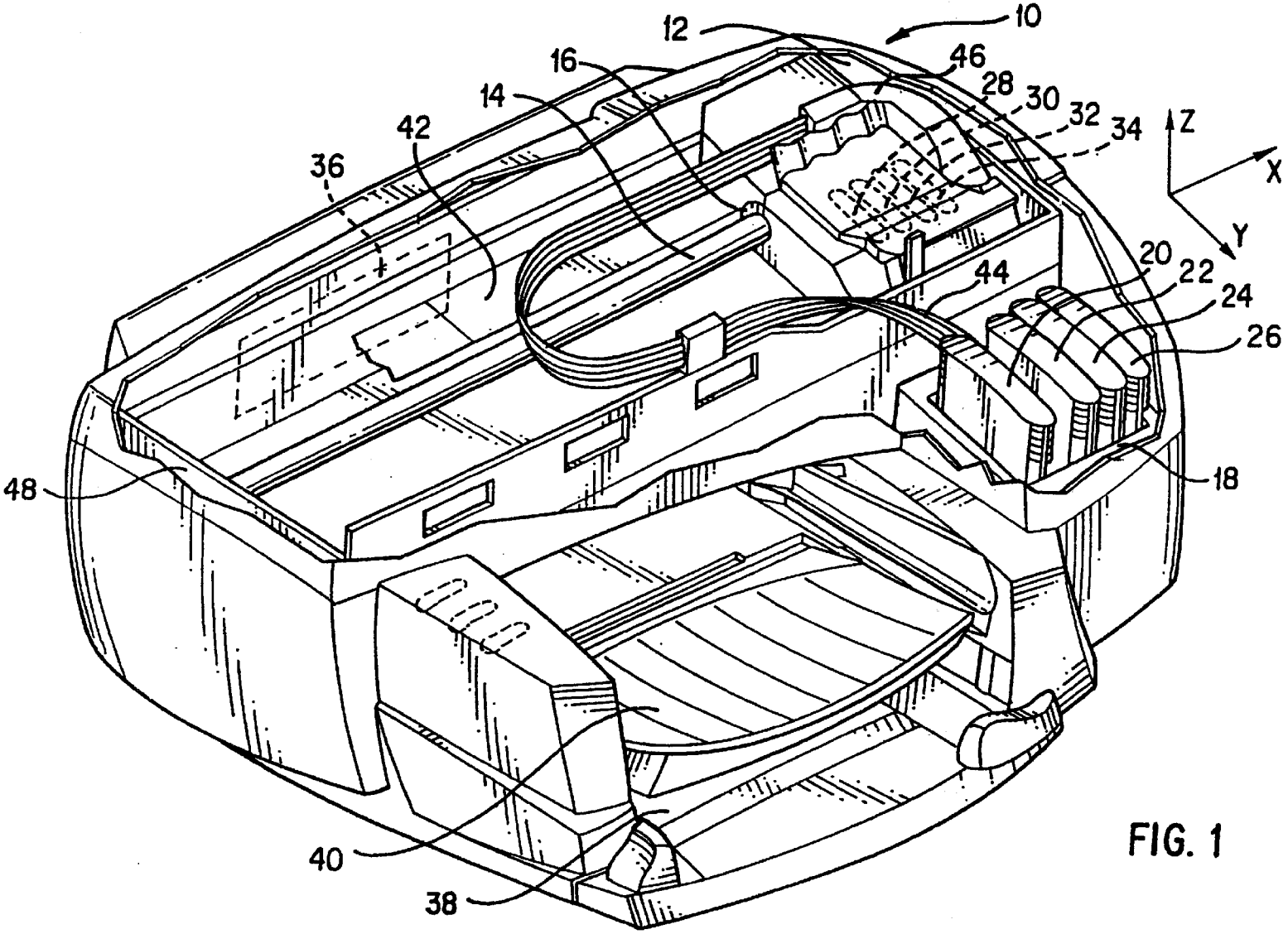
FIG. 1 is a perspective view of an inkjet printer having an ink replenishment system for multiple printheads removable mounted in a carriage.

FIG. 1 is a cutaway view of a printer 10 of the invention. Printer 10 includes a chassis 12, carriage rod 14, carriage 16, ink cartridge stall 18, ink cartridges 20, 22, 24. 26. printheads (pens) 28, 30, 32, 34 (shown in outline), controller 36 (shown in outline), input tray 38, and output tray 40. Controller 36 communicates with pens 28, 30, 32, 34 by means of a flex strip 42, in a manner well known in the art. Ink cartridge 20 holds black ink, cartridge 22 holds cyan ink, cartridge 24 holds magenta ink and cartridge 26 holds yellow ink. Similarly pen 28 prints black dots, pen 30 prints cyan dots. pen 32 prints magenta dots, and pen 34 prints yellow dots. Ink is fed from ink cartridges 20, 22, 24, 26 to pens 28, 30, 32, 34 by means of tube assembly 44. Tube assembly 44 connects with manifold 46, and inside manifold 46 the individual tubes carrying the four colored inks are separately routed to their respective valving mechanisms so that ink can be fed to the pens. Carriage 16 is shown in FIG. 1 in its "home" position at the right side of the print zone. The print zone resides between this home position and the left side 48 of chassis 12.

Carriage 16 rides along carriage rod 14 and traverses in the direction labeled X back and forth to thereby scan the pens across the print zone as dots are laid down on the page in a dot matrix pattern. For this reason, the direction X is commonly referred to as the carriage axis or scan axis.

After a print swath is complete, the paper or other print media is incrementally moved in the direction on labeled Y, so that another print swat can be printed Subsquent contiguous swaths are printed to print entire pages of text or images in a man well known in the art. The direction orthogonal to direons X and Y will be referred to herein as the Z axis. After a page of information is printed, the page is ejected onto the output tray 40, and a new sheet is "picked" from the input tray so that it can be printed on.

Figure 3:
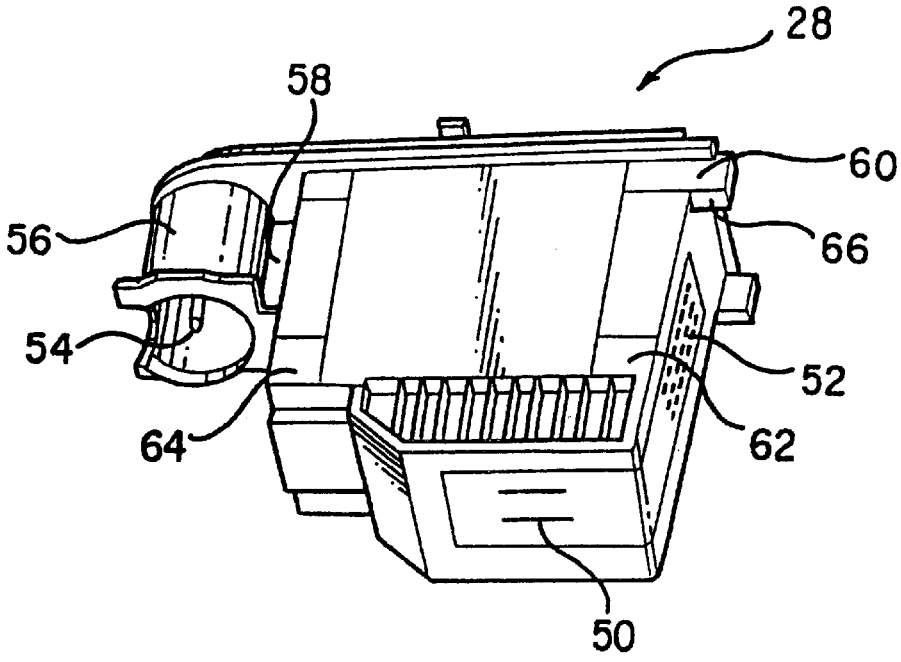
FIGS. 3 and 4 are bottom perspective views of one version of a print cartridge incorporating features of the invention.
Figure 4:
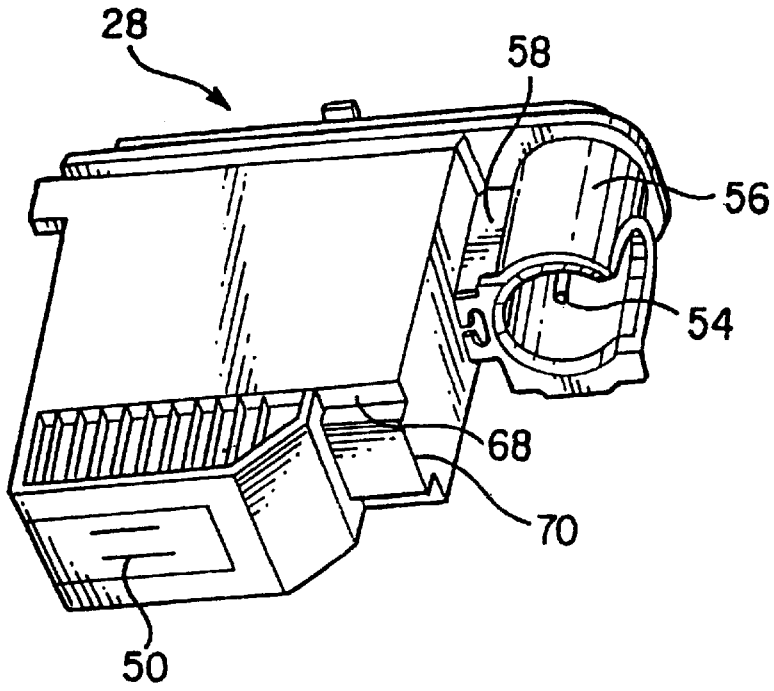
Figure 5:
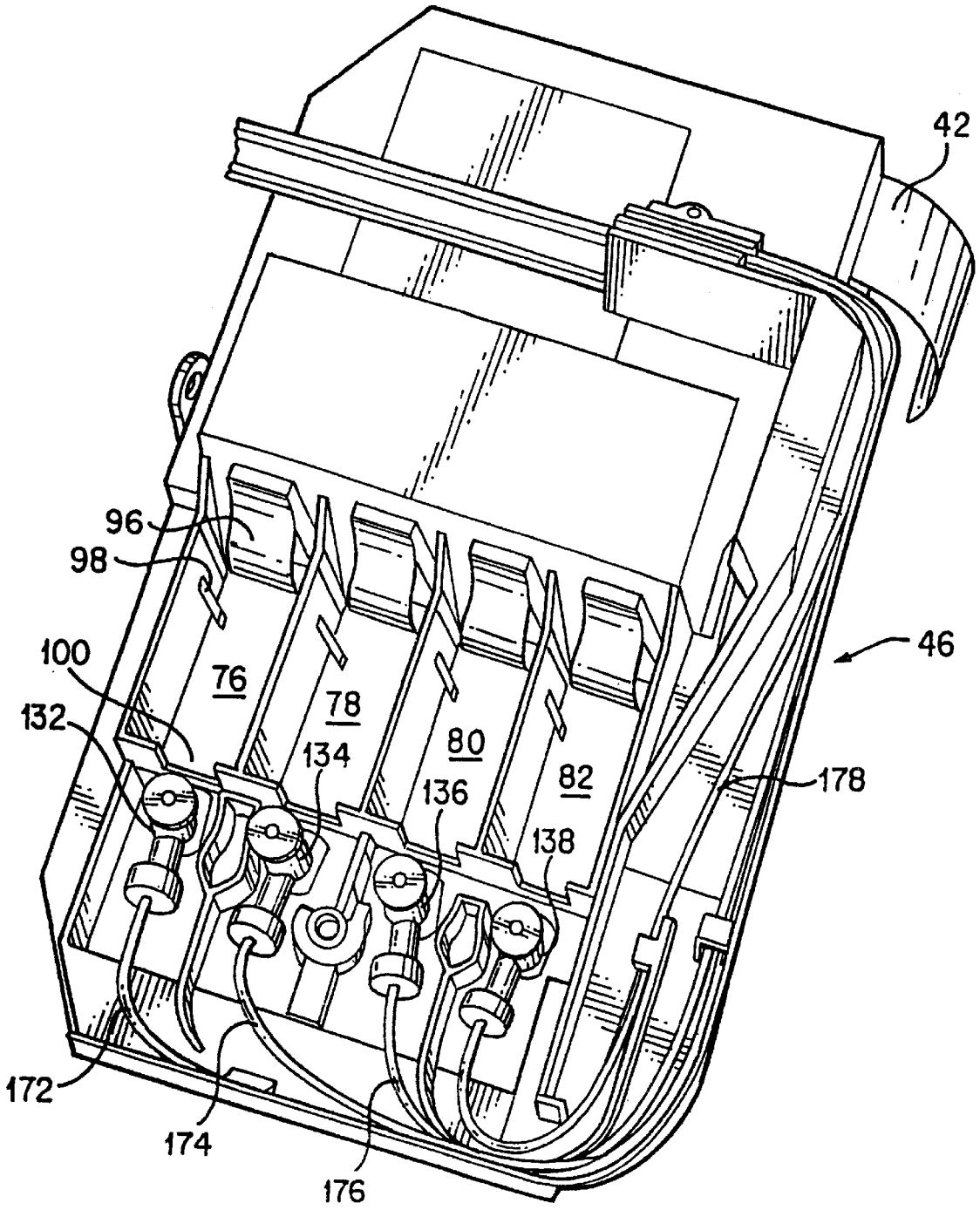
FIG. 5 is a partially cut-away top view of the carriage with the print cartridges removed, showing the ink replenishment tube routing.

FIGS. 3 and 4 illustrate pen 28 in detail, and is typical of pens 28, 30, 32, 34. This pen includes primhead nozzles 50, electrical interconnect pads 52, fluid interconnect needle 54, shroud 56, and neck 58. Pen 28 has X datums 60, 62, 64; Z datums 66 and 68; and Y datum 70. Contact pads 52 interface with a set of matching contact pads in the printer so that the printer can provide firing signals to the pen Based on these firing signals, droplets are ejected from nozzles 50. Needle 54 interfaces with a septum, described later, to provide a supply of ink to the pen Shroud 56 covers and protects needle 54. Both shroud 54 and neck 58 serve to guide the needle into its interface with its septum These functions are described more completely below.

Figure 2:
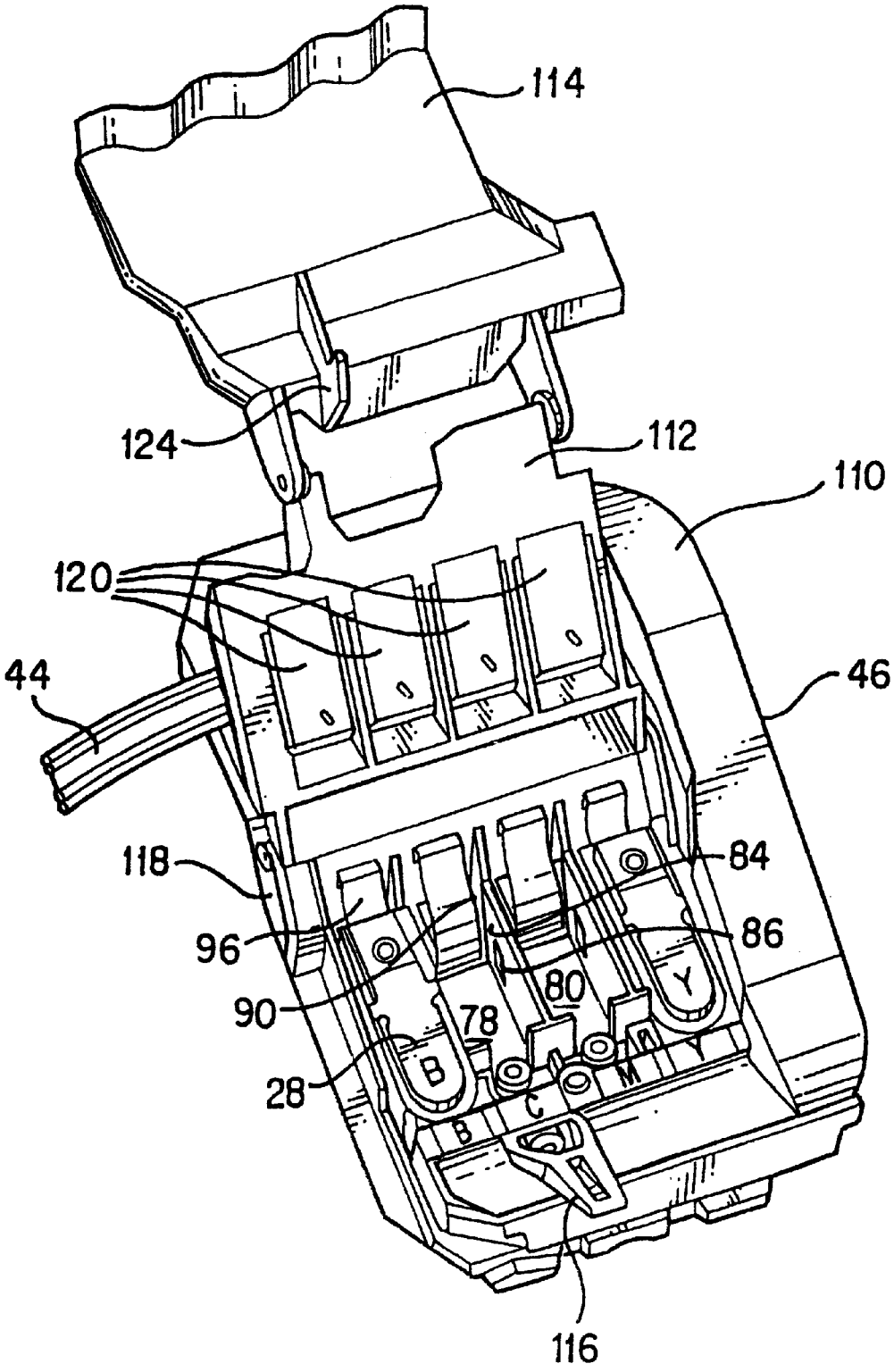
FIG. 2 shows one embodiment of a carriage incorporating features of the invention, with a latching device in open position, and black and yellow print cartridge in the carriage chutes with their print cartridge handles down.
Figure 6:
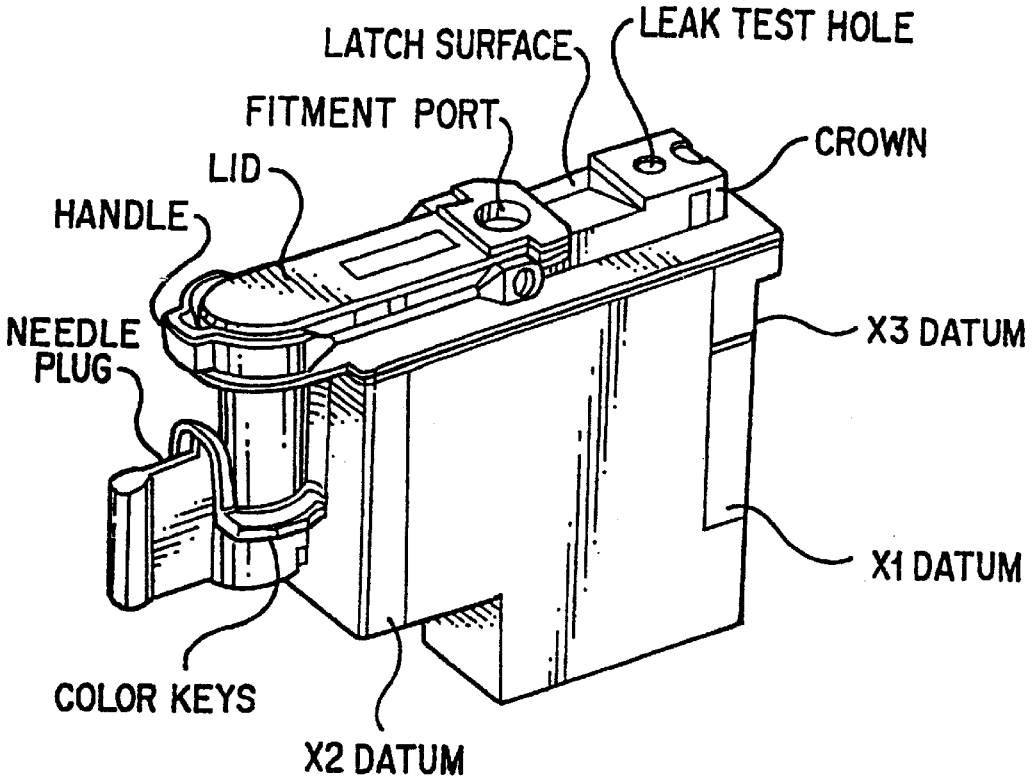
FIG. 6 is a top perspective view of a recent print cartridge embodiment showing the crown with the print cartridge handle down, and with a removable plug over the needle inlet.
Figure 7:
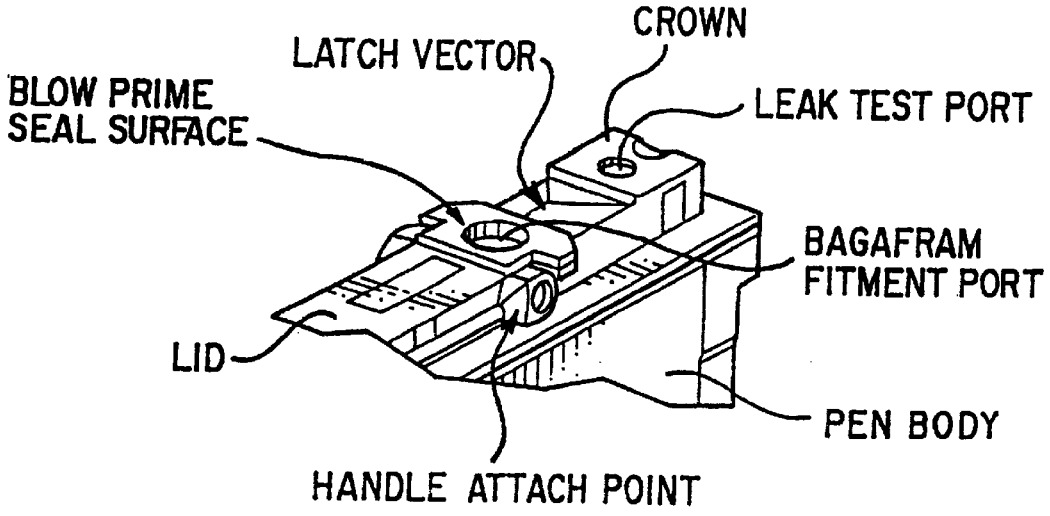
FIG. 7 shows a portion of the crown with the print cartridge handle removed.
Figure 8:
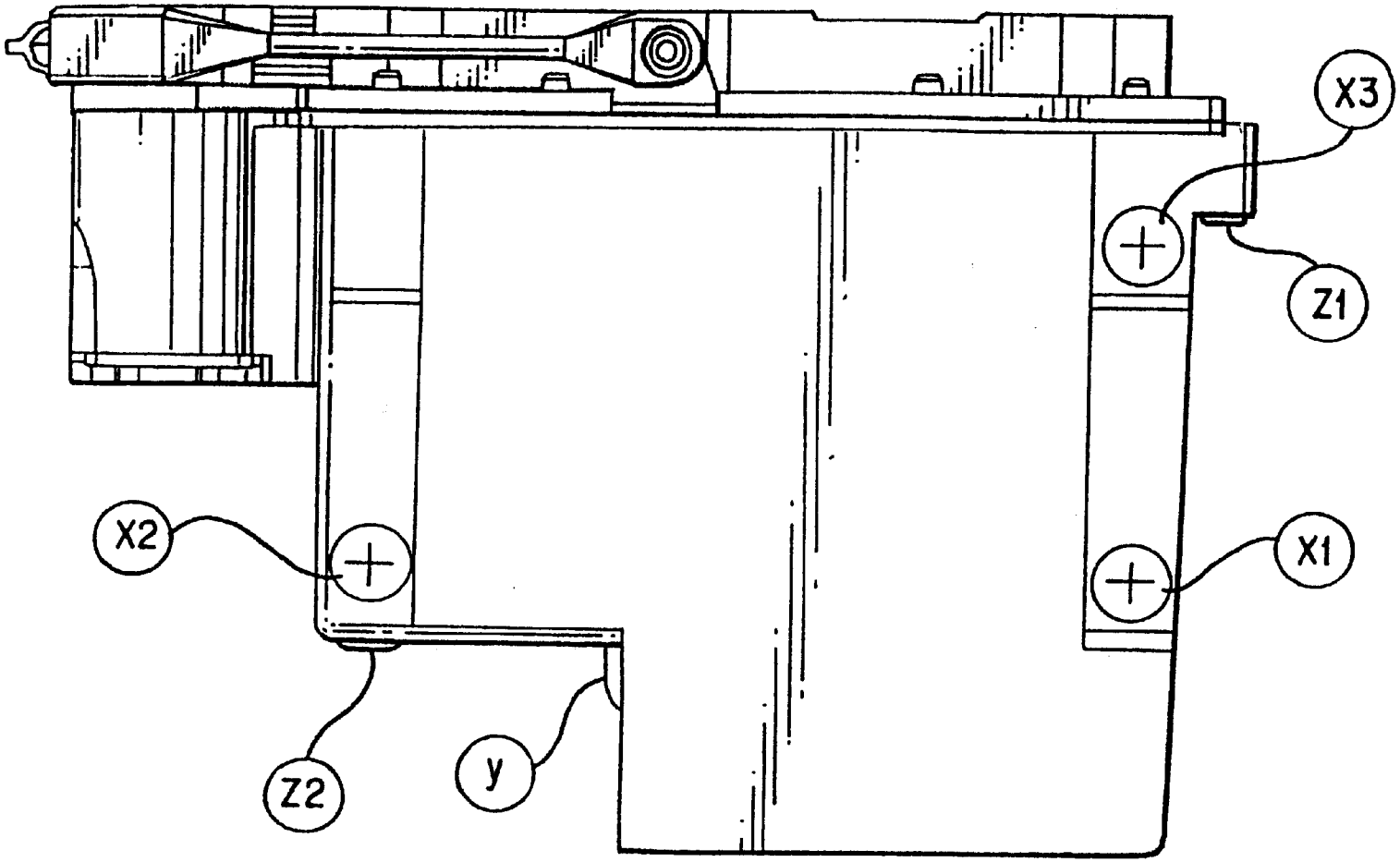
FIG. 8 is a side elevational view of the print cartridge with its handle down, and showing some of the datums.
Figure 9:
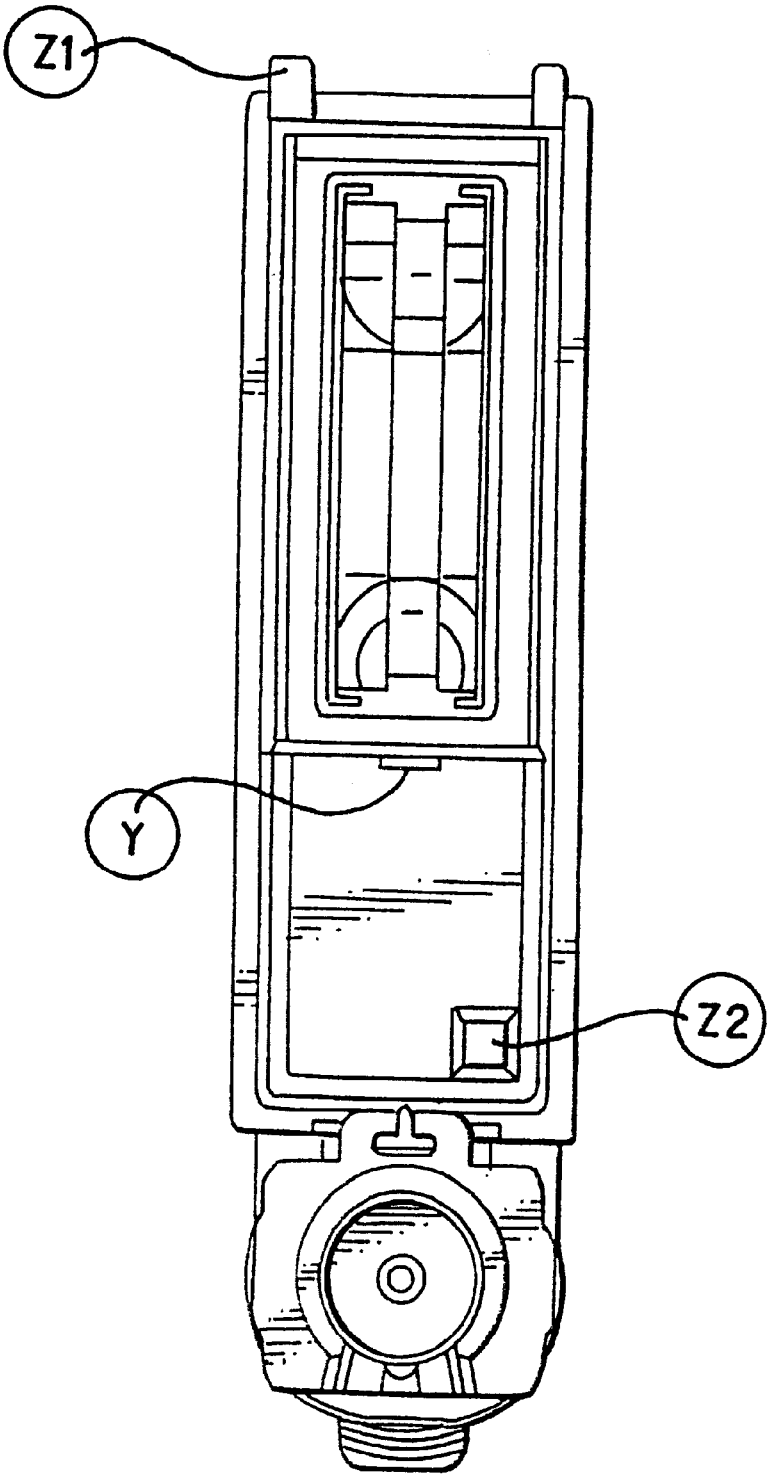
FIG. 9 is a bottom plan view of the print cartridge without its printhead and showing some of its datums.
Figure 10:
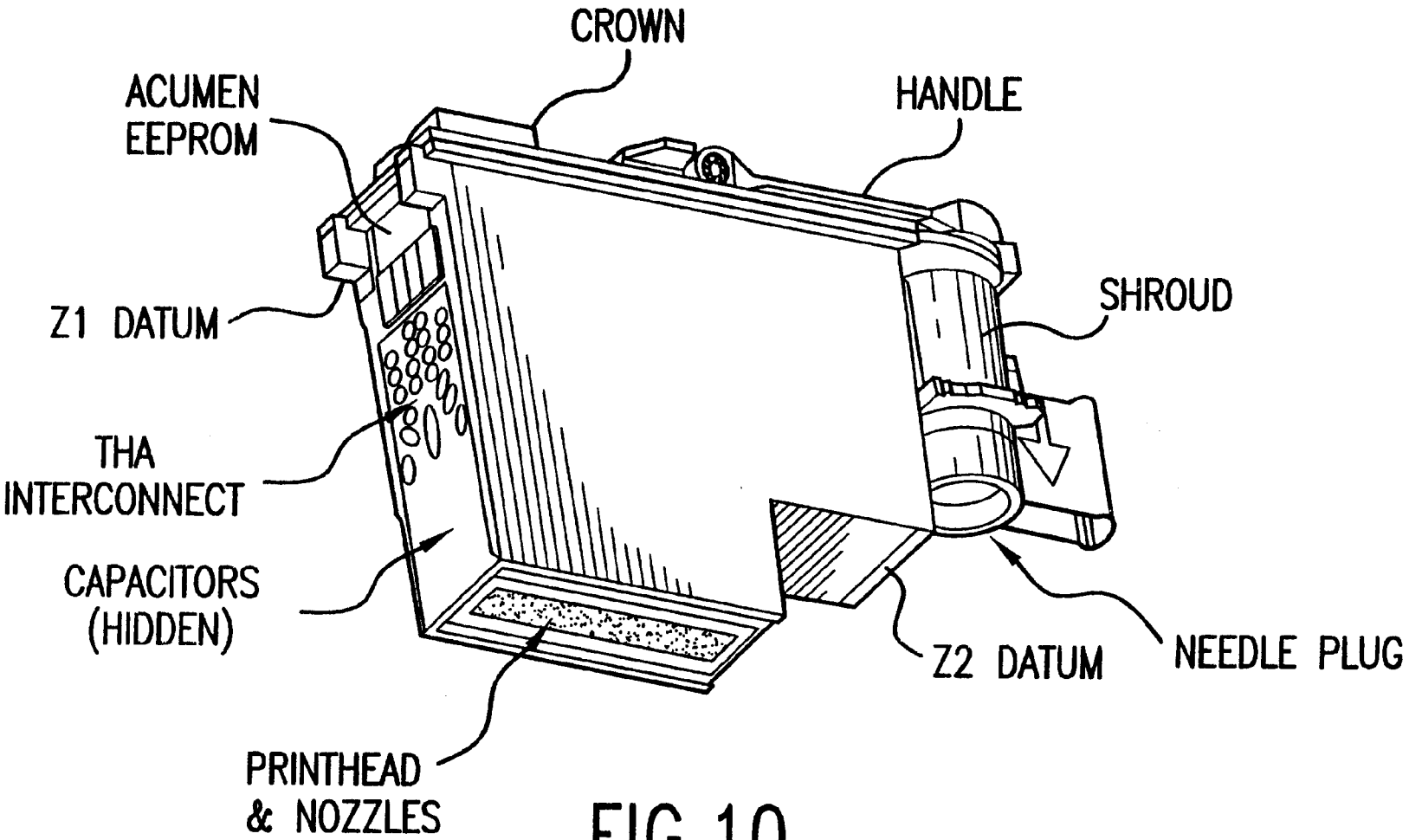
FIG. 10 is is bottom perspective view of the print cartridge of FIG. 6 showing some of the datums, the printhead and the electrical interconnect.
Figure 11:
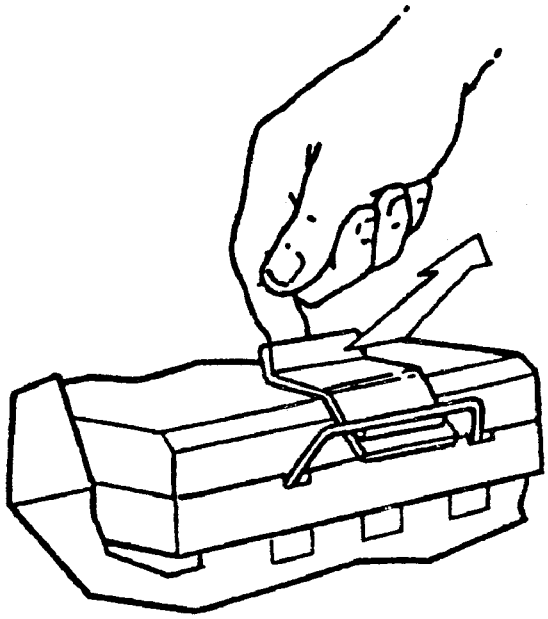
FIG. 11 shows the manner of initially unlatching a cover on the carriage for the wide format inkjet printer of FIG. 13.
Figure 12:
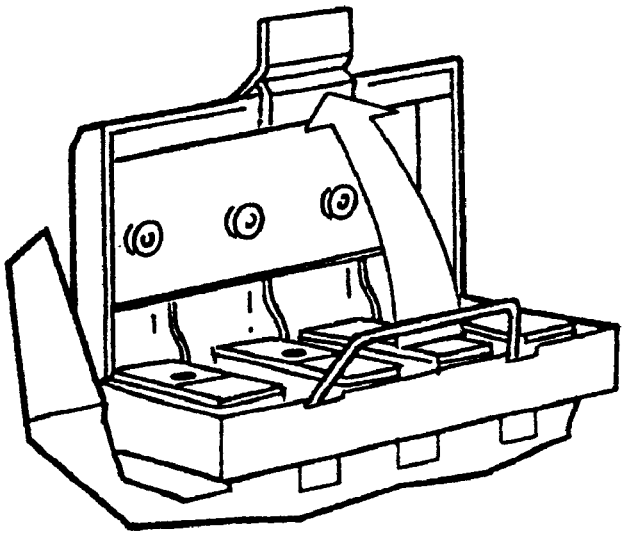
FIG. 12 shows the cover in open position allowing access to the printheads

FIGS. 2 and 6 illustrate details of carriage 16, and includes pen stalls 76, 78, 80, 82. Pens 28, 30, 32, 34 are installed into stalls 76, 78, 80 82, respectively. Stall 76 is typical and will be described in detail Stall 76 includes X, Y, and Z datums that correspond directly with the X, Y, and Z datums on pen 28, described in reference to FIGS. 3 and 4. For example, in FIG. 2, X datums 84, 96 and Z datums 90 are visible in stall 78, which datums correspond to the datums on pen 30. Stall 76 also includes contact pads 96 and notch 100. A spring is positioned behind contact pads 96 to bias the contact pads outward, or in the direction of the notch 100.

As pen 28 is installed into stall 76, neck 58 fits into notch 100. As the pen is further installed, spring 98 urges the pen toward the right (as viewed in FIGS. 3 and 4) to bias X pen datums 60, 62, and 64 against the X carriage datums position the pen in the X direction within the carriage. Carriage contact pads 96 engage with pen contact pads 52, so that the printer can communicate with the pen. Also, because of the spring behind contact pads 96, Y pen datum 70 is urged against its carriage datum to position the pen in the Y direction. By means of a latch mechanism described below, Z pen datums 66 and 68 are urged against the Z carriage datums to position the pen in the Z diretion. Thus the pen is precisely positioned in the X, Y, and Z directions with respect to carriage 16 so that droplets are accurately deposited on the page in their intended location.

FIG. 2 illustrate details of the latching mechanism that latches pens 28, 30, 32, and 34 into their respective stalls so that the pen datums are all firmly held into position against their respective carriage datums. This mechanism includes a carriage chassis 110, latch 112, handle 114, and pivot arm 116. Carriage chassis rides along carriage rod 14 at hole 118. A set of contact arms 120 is pivotally connected to latch 112, as shown, and a spring (not shown) is mounted behind each of contact arms 120 to urge contact arms 120 outward or away from latch 112. Handle 114 includes a hook 124, designed to interlock with pivot arm 116, as described below. Latch 112 is pivotally attached to carriage chassis 110, and handle 114 is in turn pivotally attached to latch 112, as shown. Pivot arm 116 is pivotally attached to carriage chassis 110, as shown.

FIG. 2 shows the latch mechanism in its fully open position, with latch 112 flipped back toward the rear of the printer and handle 114 rotated back behind latch 112. Pivot arm 116 is rotated forward out of the way. With the latch mechanism in this position, pens can be installed or exchanged. Handle 114 is rotated so that hook 124 is interlocked with pivot arm 116. The user rotates handle 114 back toward the rear of the printer (counterclockwise as viewed in FIG. 2). As the handle is thus rotated, latch 112 will be urged downward so that contact arms 120 are urged against the pens by means of springs mounted behind each contact arm.

In accordance with the design objectives, manifold 46 has various barriers, walls. and clips to channel the ink tubes. Tube 172 carries black n tube 174 carries cyan ink. tube 176 cames magenta ink, and tube 178 carries yellow ink Each of the tubes has a different length. and the different lengths of the tubes assists in the assembly of the tubes and valves in the manifold 46. The valves 132, 134, 136, 138 are connected to tubes 172, 174, 176, 178, resctively before the tubes are inserted in the manifold.

The process for installing pens is now described. This description is given with regard to pen 28, with the understanding that the process for installing the other pens is the same. The user grasps one pen 28 with the needle and printing nozzles facing down as shown in FIG. 3 and begins to position it within its stall 76. Pen 28 is positioned so that pen contact pads 52 are closest to carriage contact pads 96. Spring 98 has a high spring tension and urges pen 28 to the right as viewed in FIG. 2. Because of the spring behind carriage contact pads 96. Contact pads 96 also urge pen 28 toward the front of stall 76 (i.e., toward notch 100). Because of the frictional forces between the pen and the wails of the stall. the user will need to use some force to push the pen downward into its stall.

As the user further pushes pen 28 into its stall, neck 58 will engage within and interface with notch 100. As this happens, notch 100 positions shroud 56 over valve 132. As the user further pushes the pen down. shroud 56 will engage with valve 132 to locate valve 132 within shroud 56 and also positions needle 54 above septum and in position to pierce slit 150.

Figure 13:
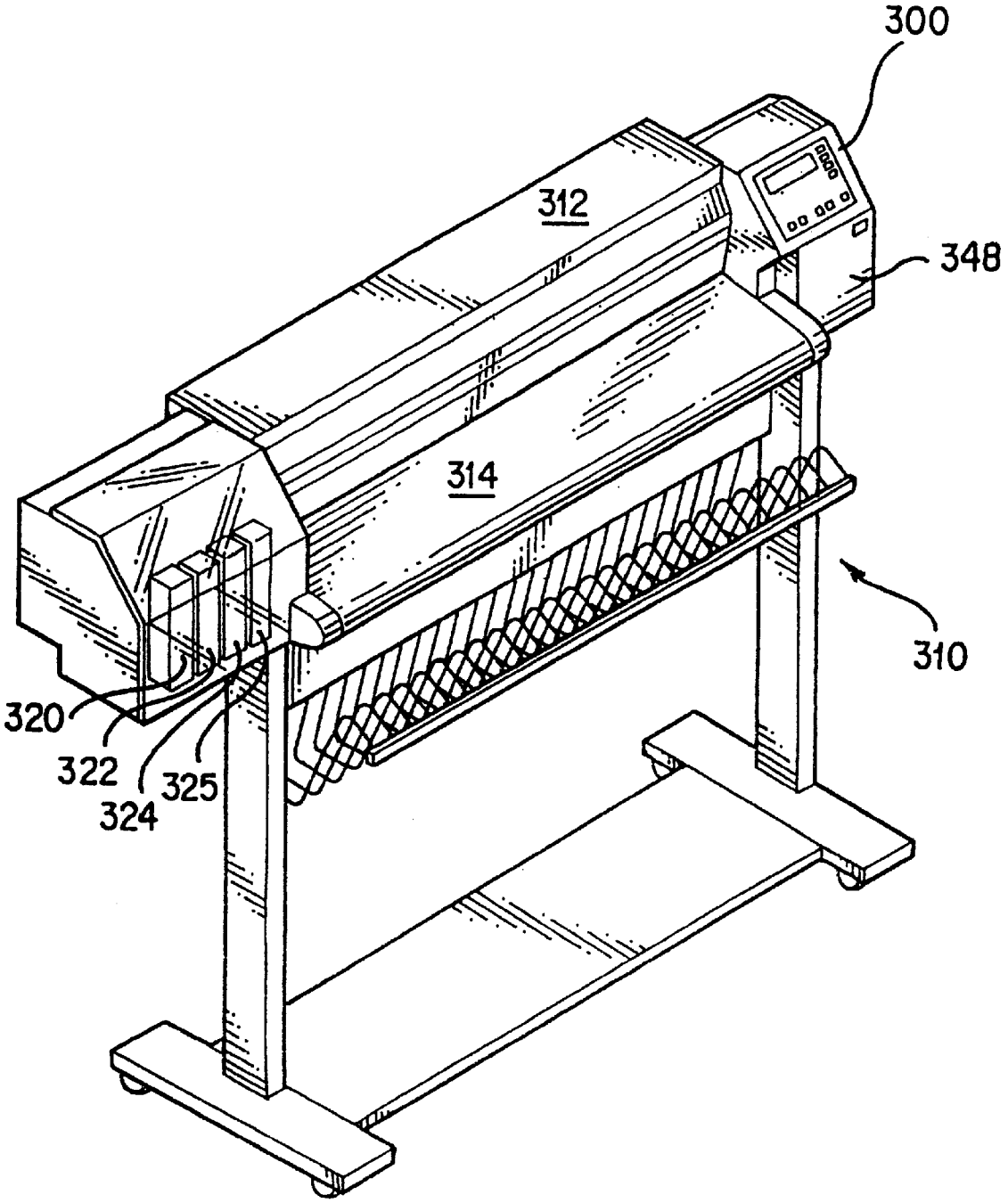
FIG. 13 is a perspective view of a large format inkjet printer incorporating the printhead of FIGS. 6–10 and the latching device of FIGS. 11–12.

FIG. 13 shows a large format printer 310 of the type which includes a transversely movable printhead carriage enclosed by a cover 312 which extends over a generally horizontally extending platen 314 over which printed media is discharged into a catcher basket. At the left side of the platen are four removable ink reservoirs 320, 322, 324, 326 which, through a removable flexible tube arrangement to be described, supply ink to four inkjet printheads mounted on the moveable carriage.

Figure 14:
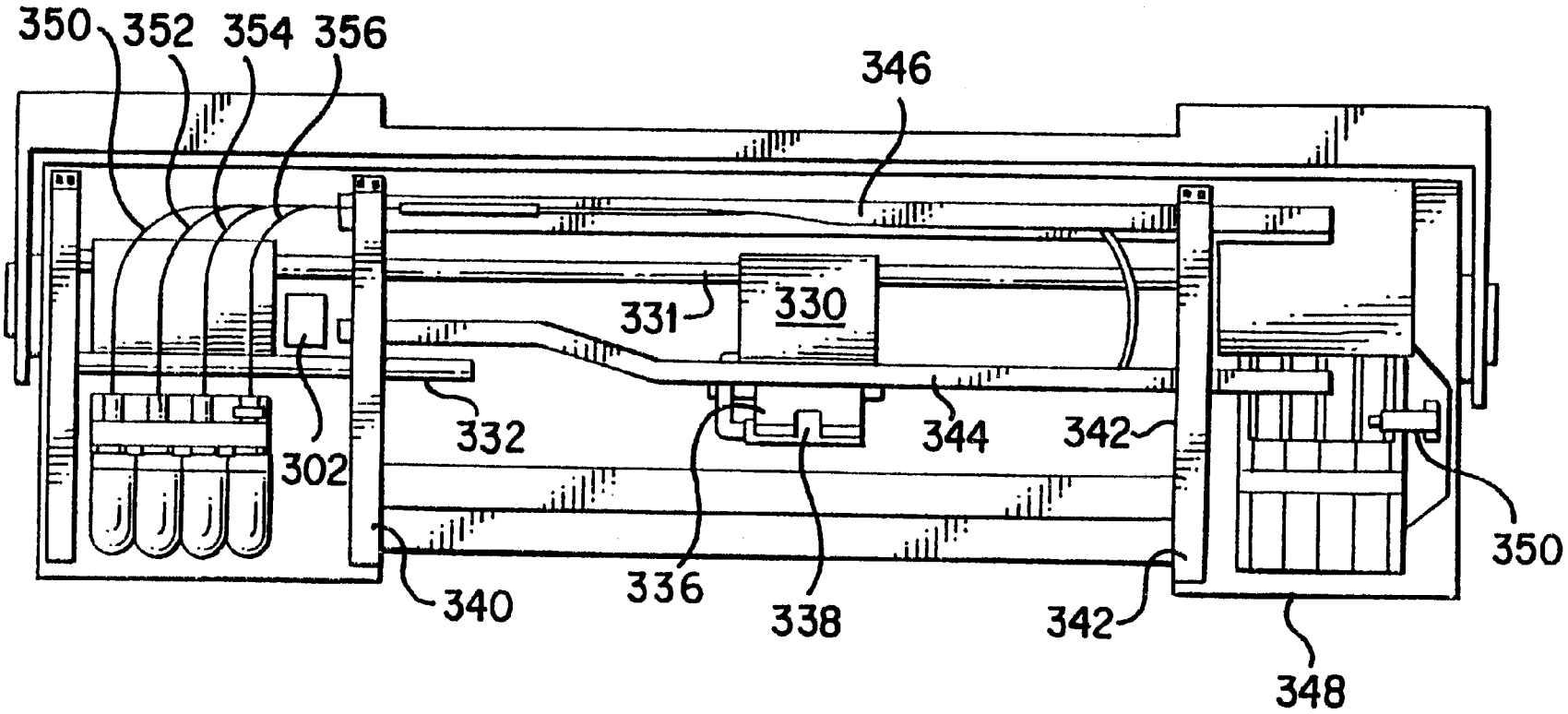
FIG. 14 is a top plan view of the large format inkjet printer with the top removed.
Figure 15:
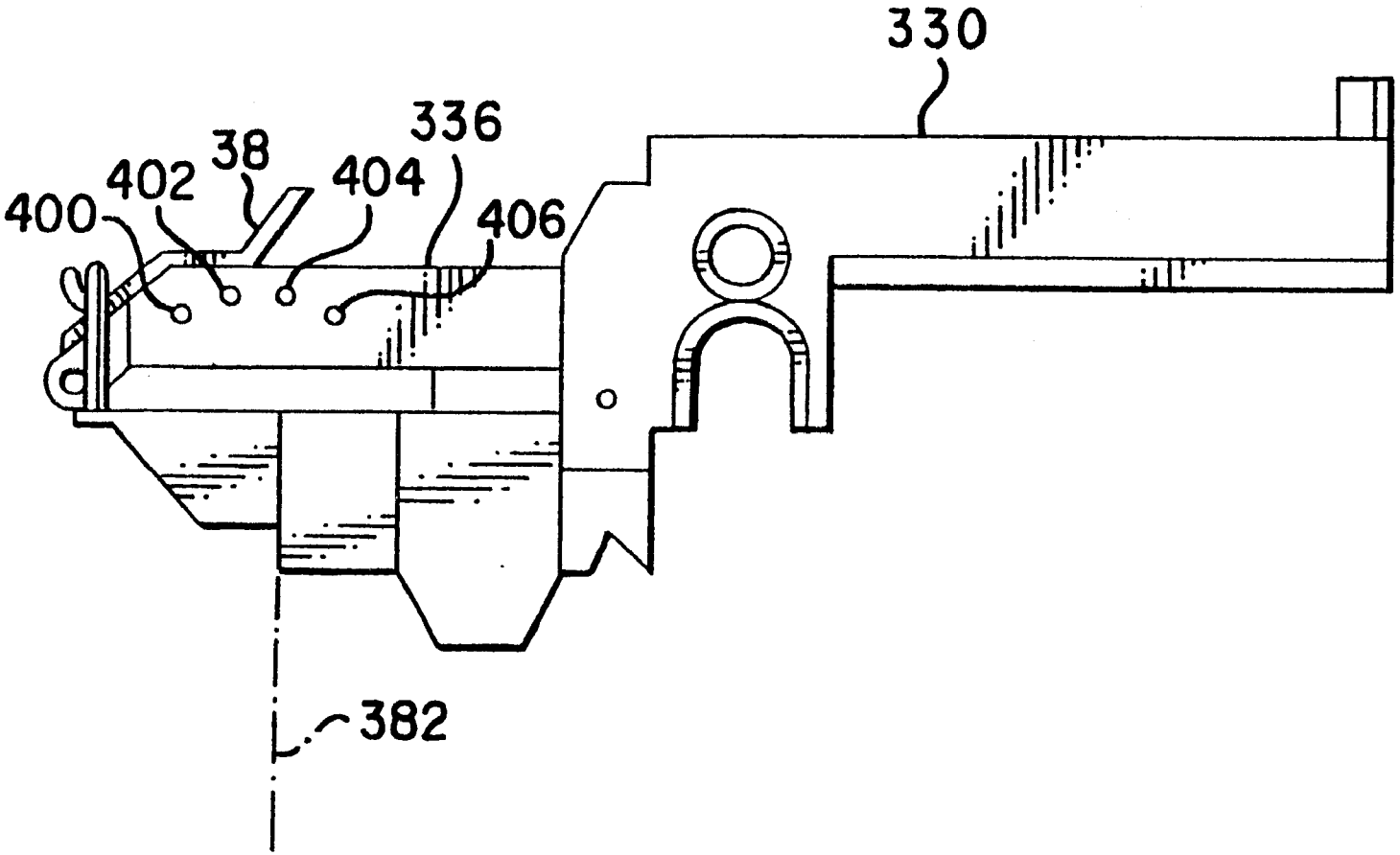
FIG. 15 is a side elevational view of the large format carriage with its latching device in closed position.

In the plan view of FIG. 14 in which the carriage cover 312 has been removed, it is seen that the printhead carriage 330 is mounted on a pair of transversely extending slider rods or guides 332, 334 which in turn are affixed to the frame of the printer. Also affixed to the frame of the printer are a pair of tube guide support bridges 340, 342 from which front and rear tube guides 344, 346 are suspended. The printhead carriage 330 has a pivotal printhead hold down cover 336 fastened by a latch 338 at the front side of the printer which securely holds four inkjet printheads, two of which is shown in FIG. 17 in place in stalls C, M, Y, K on the carriage. The front tube guide 344 is angled near the left bridge support 340 to provide clearance for opening the printhead cover 336 when the carriage is slid to a position proximate the left side of the platen 314 so that the printhead hold down cover 336 can be easily opened for changing the printheads.

A flexible ink delivery tube system conveys ink from the four separate ink reservoirs 320, 322, 324, 326 at the left side of the printer through four flexible ink tubes 350, 352, 354, 356 which extend from the ink reservoirs through the rear and front tube guides 344, 346 to convey ink to printheads on the carriage 330. The ink tube system may be a replaceable system.

Figure 16:
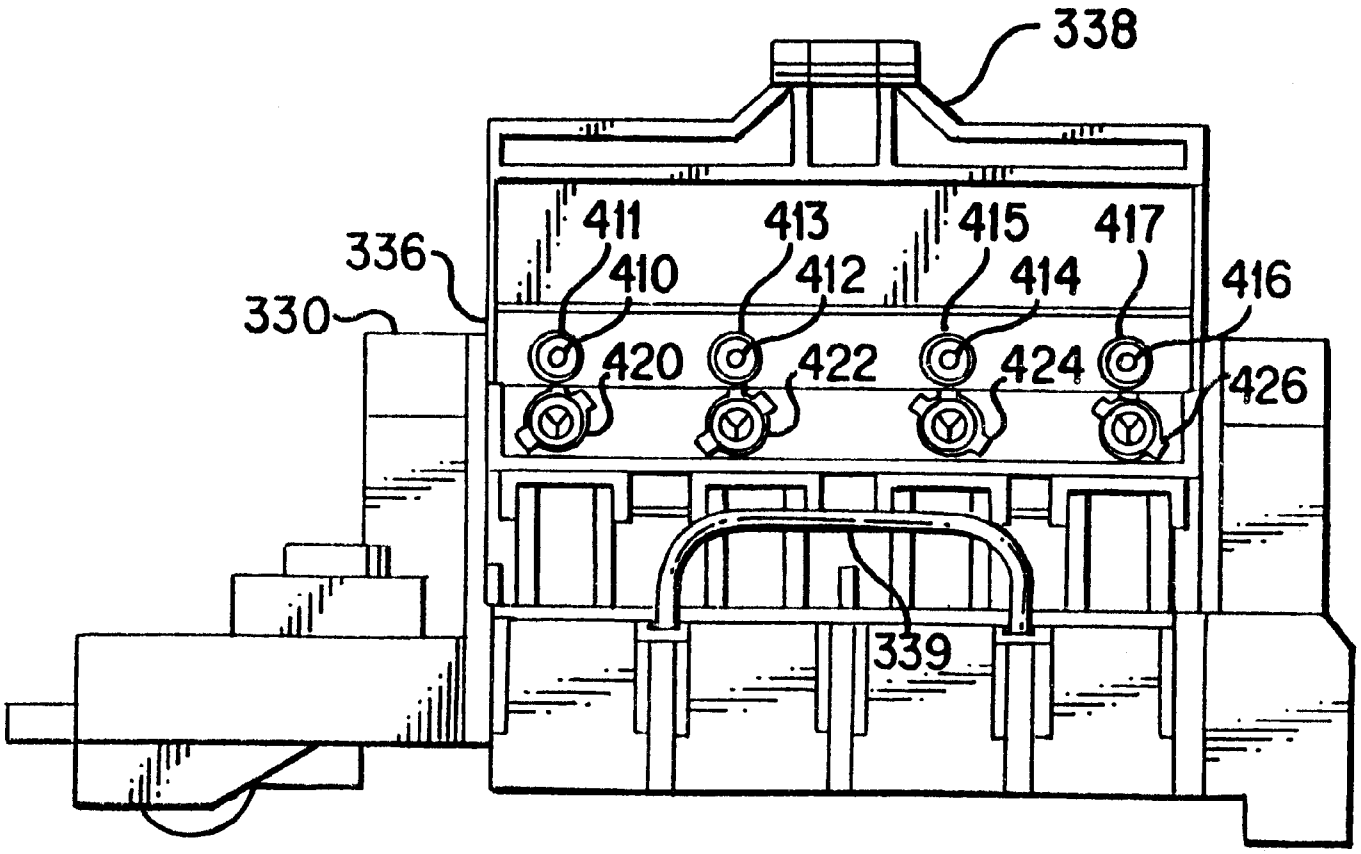
FIG. 16 is a front elevation view of the carriage with its latching device in open position.

At the right side of the printer is a printhead service station 348 at which the printhead carriage 330 may be parked for cleaning and priming the printheads. The printhead service station 348 is comprised of a plastic frame mounted on the printer adjacent the right end of the transversely extending path of travel of the printhead carriage 330. The printhead carriage 330 (FIGS. 16 and 17) includes four stalls C, M, Y, K which respectively receive four separate printheads containing colored ink such as cyan, magenta, yellow and black.

A printhead servicing pump 350 is mounted on the upper end of a pump positioning arm. Movement of the arm positions the pump at various locations along an arc centered on the pivot axis of the arm to align a pump outlet with the inlet end of one of four air conduits 400, 402, 404, 406 arcuately positioned on the side of a pivotally mounted printhead holddown cover 336 on the printhead carriage 330.

The four air conduits each 400, 402, 404, 406 are each sized to have a substantially equal volume and extend from the inlet ends at the side of the hold down cover 336 internally of the cover and terminate in downwardly directed (when the cover is closed) fluid outlets 410, 412, 414, 416 on the underside of the printhead holddown cover. The air outlets each have a compliant seal 411, 413, 415, 417 therearound which mates with corresponding air inlet ports on the top surfaces of the four printheads when positioned in their respective stalls in the printhead carriage. Also shown on the underside of the printhead holddown cover 336 are spring loaded printhead positioners 420, 422, 424, 426. It will be seen that the printhead holddown cover is pivotally connected to the carriage and fastened in its closed or printhead holddown position by a finger latch 338 and retainer 339.

Servicing of the printheads on the printhead carriage is accomplished by positioning the pump 350 for alignment with the air passageway 402, 404, 406, 408 in the printhead holddown cover which conveys air to the printhead to be serviced. This provides a fluid communication path from the pump to the vent 210 of the printhead for the purpose of priming while the printheads remain mounted within a stall of the carriage 330.

When printheads are mounted within a stall of the carriage 330 of the printer during non-priming, the vent 210 of the printhead is connected to ambient atmospheric pressure via one of the air conduits 400, 402, 404 or 406 in the printhead holddown cover 336. The fluid interconnect 229 of the printhead is connected by means of one of the flexible supply tubes 350, 352, 354, 356 to one of the four removable ink reservoirs 320, 322, 324, 326 located on the left side of the printer as seen in FIG. 13. Each ink reservoir is individually pressurised under control of the printer to deliver ink to an associated printhead. In normal printing operations the accumulator and regulator levers 207, 206 move within the printhead body 201 dependent on the ambient atmospheric pressure and speed of printing. If the atmospheric pressure increases, or the pressure within the ink chamber 232 decreases, for example, due to ink being ejected from the printhead during printing, the flexible bag 208 fills with air drawn through the air conduit in the carriage cover via the vent 210 of the printhead. Expansion of the bag 208 causes rotation of the accumulator lever 207.

The recent embodiment of the unique compact print cartridge in its presently preferred embodiment is employed in a large format rollfeed/sheet feed printer. While some of the features are closely similar to the earlier embodiment shown in FIGS. 3–4 and other related Figs., new reference numerals will be used for clarification. In that regard, the print cartridge 602 includes a body 603 which forms an internal reservoir and a lower snout 604 which extends more than half the distance across a lower end of the internal reservoir and defines a nozzle area 606 from which ink is applied to media. An upper crown 608 includes on one end (generally above the snout) a leak test hole 610, a slanted vector force contact area 612, and a vent hole 614 to the valve-actuator bellows surrounded by a primer seal area 615. The other end of the crown includes a lid 616 which covers an enclosed passage connecting the fluid interconnect 618 with an inlet valve to the internal reservoir, and a peripheral ledge 619 which provides a recess for receiving a handle 620 in its down position. The fluid interconnect includes a shroud 622 surrounding a downwardly projecting needle 623 which is protected by a plug 624 during shipment and before installation in the carriage. A color keying component 626 is used to assure that each print cartridge is installed in its proper chute or slot in the carriage.

The datums on the print cartridge include three X datums 630, 632, 634, one Y datum 636 and two Z datums 638, 640 as shown in the Figs which are arranged to assure proper and secure positioning against matching datums surfaces in the carriage. In contrast to some earlier print cartridges, these datums need not be machined in order to avoid misalignment.

The handle 620 includes enlarged hubs 650 which are pivotally mounted on pins 652. The hubs are at each end of two small diameter legs 654 which join together to form a thickened loop 656 having an outwardly extending tab 658.

It will be understood from the foregoing description and accompanying drawings that the print cartridge of the present invention provides a set of unique mechanical interface features that enable high performance printheads (sometimes referred to herein as "pens") designed to receive ink from separable external ink supplies while maintain a compact printer form factor. This feature set includes a novel combination of outside form factor, datum arrangement, latching, and handle which have been matched with corresponding features in the carriage to facilitate print cartridge installation, printing, servicing, removal and replacement while maintaining predictable and precise tolerances around the required fluid and electrical interconnections.

The lower height dimension serves to minimize the overall printer height, and allows a printer to be stored and/or used in typical nineteen inch rack mountable hardware. The minimal width serves to diminish the eight-times multiplier effect caused by a four printhead carriage overtravel on each end of the carriage scan. Depth has the least impact on the product size, and in fact the additional depth helps to provides better theta-z rotational control of the print cartridges mounted in the carriage.

Weight is important to minimize motor force requirements which has a direct impact on product cost. Also, printers using heavier print cartridges often generate objectionable shaking and vibrations when used on a high performance carriage which has an increased range of acceleration/deceleration at both ends of the scan.

The following table shows the changes for the new 600 dpi printhead of the present invention as compared to a typical previous 600 dpi printhead of Hewlett-Packard:

The improved datum arrangement has been developed in order to successfully implement the small form factor and to assure precise positioning during the life of a semi-permanent print catridge and printhead. In this regard, the datum arrangement minimizes undesirable theta-z variation. also the datum locations are spaced apart as much as possible from the printhead itself to minimize any adverse effect of datum engagement generated particles on successful ink ejection from the printhead.

The position of the latch force vector minimizes alignment variation for a small form factor print catridge. The latch applies a force of the top of the print cartridge that passes between the fluid and electrical connections to the printhead. The fluid and electrical connections are made at opposing ends of the print cartridge. The latch force vector is applied at a point between these connections, and in a preferred embodiment is applied at a point that is proximate to the intersection of a plane that bisects the nozzle plane and passes through the top of the print cartridge. The exact predetermined location for applying the latch force minimizes the overall force required to accurately position this small form factor print cartridge. Moreover, if there is a printhead/media crash that knocks the print cartridge out of alignment, the latch mechanism in combination with the datums will tend to correctly reseat the print cartridge in that carriage.

While particular exemplary embodiments have been shown and described, it will be appreciated by those skilled in the art that various changes, substitutions and improvements can be made without departing from the spirit and scope of the invention as set forth in the following claims.

We claim as our invention:

1. An inkjet printing system comprising:

a printer frame;

a carriage having a fluid replenishment interface connected to an auxiliary fluid supply, and also having an electrical signal inter connect;

a print cartridge with a top portion to facilitate manual mounting and a lower portion for carrying a printhead, said print cartridge capable of being removabley mounted in said carriage and having a fluid coupling and signal conductive pads;

a plurality of datums on said print cartridge for engaging matching datums in said carriage and to provide final precise positioning of the printhead over a print zone, and of said fluid coupling with said replenishment interface, and of said signal conductive pads with said signal interconnect in order to deliver ink from said auxiliary fluid supply to said printhead without having to remove said printhead from said carriage.

2. The printing system of claim 1 wherein said carriage includes a latching member, and said top surface of said print cartridge includes a contact surface for engagement with said latching member.

3. The printing system of claim 2 wherein said contact surface is slanted in order for said latching member to exert both a downwardly force in a Z direction and a laterally directed force in an X direction against said print cartridge.

4. The printing system of claim 2 wherein said contact surface is located in a position vertically above the printhead.

5. The printing system of claim 1 wherein said print cartridge includes X, Y and Z datums, with at least one Z datum located proximate to said fluid coupling, and at least another different Z datum located proximate to said signal conductive pads.

6. The printing system of claim 1 which includes X, Y and Z datums, wherein at least two Z datums are located at different vertical distances from the printhead.

7. The printing system of claim 1 which includes a supply of liquid in said auxiliary fluid supply.

8. The printing system of claim 1 which includes a supply of liquid ink in said auxiliary fluid supply.

9. The printing system of claim 1, wherein the print cartridge has opposed first and second side portions extending transversely to said top portion and said lower portion, said signal conductive pads are attached at said first side portion and said fluid coupling is adjacent said second side portion.

10. A print cartridge mountable in a carriage having a fluid interface from an auxiliary supply and an electric interconnect, comprising:

a plurality of x-datums;

a plurality of z-datums;

at least one y-datum, wherein said datums are seated against matching datums in said carriage upon complete insertion of said print cartridge in said carriage;

a fluid coupling which faces downwardly toward media in a print zone and mated with the fluid interface of the carriage upon said complete insertion of the cartridge in the carriage.

11. The print cartridge of claim 10 which includes signal conductive pads on said print cartridge which face laterally.

12. The print cartridge of claim 10 which includes an adaptor for plugging and protecting said fluid coupling during shipment and storage before installation of said print cartridge on the carriage.

13. The print cartridge of claim 10 which includes three x-datums.

14. The print cartridge of claim 13 wherein at least two x-datums are located at different distances from media in a print zone.

15. The print cartridge of claim 10 which includes two z-datums.

16. The print cartridge of claim 15 wherein said two z-datums are located at different distances from media in a print zone.

17. The printing system of claim 10 which includes a supply of liquid in said auxiliary fluid supply.

18. The printing system of claim 10 which includes a supply of liquid ink in said auxiliary fluid supply.

19. A method of installing a print cartridge in a carriage, the carriage having a fluid replenishment interface connected to an auxiliary supply and also having an electrical interconnect, comprising:

providing a print cartridge having a fluid coupling and signal conductive pads, with at least one z-axis datum proximate to the fluid coupling and at least another z-axis datum proximate to the signal conductive pads;

providing a carriage having a vertical chute capable of removably holding the print cartridge over a print zone;

positioning the print cartridge over the vertical chute and applying downward manual force to the print cartridge to mount the print cartridge in the carriage;

applying a latching force against the print cartridge to assure contacting engagement of the one z-axis datum and the another z-axis datum with matching datum surfaces, respectively, on the carriage, while at the same time assuring operative connection between the electrical interconnect and the signal conductive pads, as well as between the fluid replenishment interface and the fluid coupling; and passing fluid from the auxiliary supply to the print cartridge during a printing operation without having to remove the print cartridge from the carriage.

20. The method of claim 19 which includes providing a supply of liquid ink in the auxiliary supply.

21. The method of claim 19 which includes locating the auxiliary supply in an off-carriage location, connecting the auxiliary supply to the fluid replenishment interface on the carriage through flexible tubes, and providing a supply of liquid in the auxiliary supply.

22. An inkjet printing system comprising:

a printer frame;

a carriage having a fluid replenishment interface connected to an auxiliary fluid supply, and also having an electrical signal interconnect;

a print cartridge with a top portion to facilitate manual mounting and a lower portion for carrying a print-head, said print cartridge capable of being removably mounted in said carriage and having a fluid coupling and signal conductive pads attached at said first side portion, said fluid coupling adjacent said second side portion;

said carriage further including a latching member, the latching member for applying a latch force vector to the top portion of the print cartridge at a location between the fluid coupling and the signal conductive pads;

a plurality of datums on said print cartridge for engaging matching datums in said carriage and to provide final precise positioning of the printhead over a print zone, and of said signal conductive pads with said signal interconnect in order to deliver ink from said auxiliary ink supply to said printhead without having to remove said printhead from said carriage.

23. The printing system of claim 22, wherein said printhead comprises a planar nozzle array and wherein said location is proximate to an intersection of a plane which bisects a plane of the nozzle array and the top portion of the print cartridge.

24. A print cartridge mountable in a carriage having a fluid interface from an auxiliary supply and an electric interconnect, comprising:

a plurality of x-datums;

a plurality of z-datums;

at least one y-datum, wherein said datums are seated against matching datums in said carriage upon complete insertion of said print cartridge in said carriage;

a fluid coupling which faces downwardly toward media in a print zone and mated with the fluid interface of the carriage upon said complete insertion of the cartridge in the carriage;

signal conductive pads which face laterally; and opposed first and second side portions extending transversely to a top portion and a lower portion, said signal conductive pads attached at said first side portion and said fluid coupling adjacent said second side portion.

* * * * *

UNITED STATES PATENT AND TRADEMARK OFFICE

CERTIFICATE OF CORRECTION

PATENT NO. : 6,494,630 B2
DATED : December 17, 2002
INVENTOR(S) : Williams et al.

It is certified that error appears in the above-identified patent and that said Letters Patent is hereby corrected as shown below:

Column 7,
Lines 52 and 53, insert the following:

TABLE I

| | # of Nozzles | Height | Width | Depth | Weight with ink |
|---|---|---|---|---|---|
| Old Spring-Bag | 300 | 93 mm | 18.7 mm | 60 mm | 113 gms |
| New Compact Size | 512 | 51 | 15.9 | 70 | 38 gms |

Column 8,
Line 22, delete “inter connect” and insert therefor -- interconnect --.
Line 25, delete “removabley” and insert therefor -- removably --.

Column 10,
Line 17, delete “pads” and insert therefor -- pads, the print cartridge having opposed first and second side portions extending transversely to said top portion and said lower portion, said signal conductive pads --.
Line 26, after “zone,” insert -- and of said fluid coupling with said replenishment interface, --.

Signed and Sealed this

Twenty-seventh Day of April, 2004

JON W. DUDAS
*Acting Director of the United States Patent and Trademark Office*